United States Patent [19]

Arita et al.

[11] 4,431,492

[45] Feb. 14, 1984

[54] ALUMINUM ELECTROLYTIC CELL ARRAYS AND METHOD OF SUPPLYING ELECTRIC POWER TO THE SAME

[75] Inventors: Yoji Arita; Yuzo Seo, both of Yokohama, Japan

[73] Assignee: Mitsubishi Keikinzoku Kogyo Kabushiki Kaisha, Tokyo, Japan

[21] Appl. No.: 370,142

[22] Filed: Apr. 20, 1982

[51] Int. Cl.[3] ..... C25C 3/16; C25C 3/20

[52] U.S. Cl. ..... 204/67; 204/243 M

[58] Field of Search ..... 204/67, 243 R–247, 204/228

[56] References Cited

U.S. PATENT DOCUMENTS

| | | | |
|---|---|---|---|
| 3,415,724 | 12/1968 | Heaton et al. | 204/67 |
| 3,969,213 | 7/1976 | Yamamoto et al. | 204/244 |
| 4,049,528 | 9/1977 | Morel et al. | 204/243 M |
| 4,194,958 | 3/1980 | Nebell | 204/243 M |
| 4,270,993 | 6/1981 | Arita | 204/243 M X |
| 4,313,811 | 2/1982 | Blanc | 204/243 M |
| 4,326,939 | 4/1982 | Schmidt-Hatting | 204/244 X |

*Primary Examiner*—Donald R. Valentine

*Attorney, Agent, or Firm*—Oblon, Fisher, Spivak, McClelland & Maier

[57] ABSTRACT

In an array of rectangular aluminum electrolytic cells, each cell is provided with a plurality of anode electrodes, a plurality of current collecting cathode bars parallel with shorter side walls and located at a bottom of the cell and a plurality of side cathode bus bars extending along longer side walls. The cathode bars are divided into a least two groups. The current flowing through respective groups is collected at their centers on the one side and current flowing through respective groups is collected at both ends thereof on the other side. The collected currents are supplied to the anode electrodes of a next cell.

7 Claims, 5 Drawing Figures

ALUMINUM ELECTROLYTIC CELL ARRAYS AND METHOD OF SUPPLYING ELECTRIC POWER TO THE SAME

BACKGROUND OF THE INVENTION

This invention relates to an aluminum electrolytic cell array and a method of supplying electric power to the same, and more particularly an improved aluminum electrolytic cell array and a method of supplying electric power to the same in which creation of magnetic field which causes bending and fluctuation of the surface of molten aluminum in the cell can be decreased.

As is well known in the art, aluminum is manufactured by electrolyzing in electrolytic cells alumina dissolved in an electrolytic bath consisting essentially of cryolite. The aluminum thus formed is collected in the bottom of the cell and the surface of the molten aluminum acts as an actual cathode electrode. When subjected to an external force the surface of the molten aluminum tends to bend or fluctuate causing local decrease in the interelectrode spacing as well as decrease in the current efficiency. This phenomenon becomes remarkable with the increase in the current capacity which makes it difficult to increase the capacity of the cell.

The force acting upon the molten aluminum in the electrolytic cell is mainly created by the interaction between the current flowing through the molten aluminum and magnetic field created by current flowing through bus bars extending about the cell. We have found that the force that bends or fluctuates the surface of the molten aluminum increases with the variation in the horizontal direction of the vertical component of the magnetic field in the molten aluminum, that is the gradient or slope of the vertical component of the magnetic field. In a prior art electrolytic cell installation in which a number of cells are disposed side by side, since the bus bars are disposed in a manner as will be described later the current concentrates near the shorter side wall of the cell to increase the slope of the vertical component of the magnetic field at this portion. Consequently, it has been inevitable that excessive bending or fluctuation of the surface of the molten aluminum is caused. We have now succeeded to obviate these difficulties by improving the arrangement of the bus bars about the electrolytic cell.

SUMMARY OF THE INVENTION

Accordingly, an object of this invention is to provide an improved aluminum electrolytic cell array and a method of supplying electric power thereto capable of suppressing creation of magnetic field that bends or fluctuates the surface of the molten aluminum in the cell.

Another object of this invention is to provide a novel aluminum electrolytic cell array and a method of supplying electric power thereto capable of decreasing generation of vertical magnetic field in the cell and making uniform the distribution of the vertical magnetic field.

A further object of this invention is to provide an aluminum electrolytic cell array and a method of supplying electric power thereto capable of maintaining in a satisfactory condition the magnetic field distribution in an electrolytic cell adjacent to an electrolytic cell not in operation.

According to one aspect of this invention there is provided a method of supplying electric power to an array of a plurality of rectangular aluminum electrolytic cells which are arranged side by side, each cell being provided with a plurality of anode electrodes, a plurality of current collecting cathode bars parallel with shorter side walls thereof and located at a bottom of said cell, and a plurality of current collecting cathode bus bars disposed along longer side walls of said cell, the method comprising the steps of dividing current collecting cathode bars into a plurality of groups each consisting of adjacent current collecting cathode bars along the longer side walls of respective cells; collecting current flowing through respective current collecting cathode bar groups at their centers on one sides of respective cells; collecting current flowing through respective current collecting cathode bar groups at their opposite ends on the other sides; and supplying current to the anode electrodes of the next cell from respective current collecting points through connecting bus bars extending above the longer side wall on an upstream side of the next cell, connecting bus bars from respective current collecting points on the upstream side of the respective cells extending beneath the cell.

According to another aspect of this invention there is provided an array of a plurality of rectangular aluminum electrolytic cells which are arranged side by side; each cell being provided with a plurality of anode electrodes, a plurality of current collecting cathode bars parallel with shorter side walls and located at a bottom of the cell and a plurality of current collecting cathode bus bars disposed along longer side walls of said cell; current collecting cathode bars being divided along the longer side walls of respective cells into a plurality of groups each consisting of adjacent current collecting cathode bars; means for collecting current flowing through respective current collecting cathode bar groups at their centers on one sides of respective cells; means for collecting current flowing through respective current collecting cathode bar groups at opposite ends of the groups on the other sides of respective cells; and means including connecting bus bars for supplying collected currents to the anode electrodes of the next electrolytic cell, the connecting bus bars extending above the longer side wall on an upstream side of the next cell and connecting bus bars from the upstream side of respective cells extending beneath the cell.

Where one cell in the array becomes quiescent, the current collecting cathode bus bars between the quiescent cell and operating cells on both sides thereof are short circuited by removable plugs so as to maintain the magnetic field distribution in a favorable state.

DESCRIPTION OF THE PREFERRED EMBODIMENTS

Figure 2:
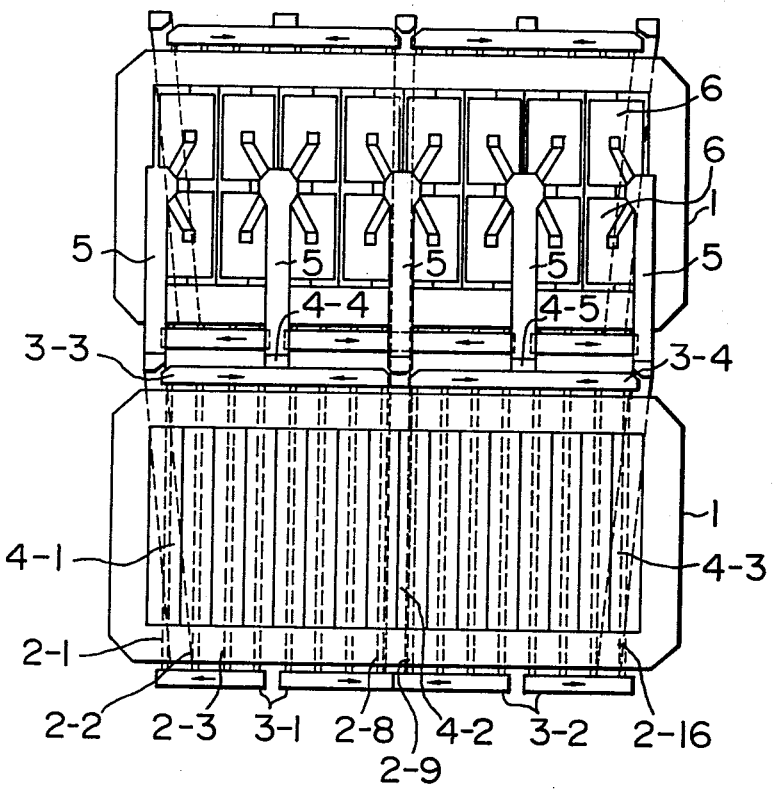
FIG. 2 is a diagrammatic plan view showing one example of a bus bar arrangement which is arranged to supply electric power to the electrolytic cells according to the method of this invention, in FIGS. 1 and 2 anode electrodes and anode bus bars of one cell being omitted.

Referring to FIG. 2, each electrolytic cell 1 shown therein is provided with 16 current collecting cathode bars 2-1 through 2-16 which are divided into two groups of 2-1 through 2-8 and 2-9 through 2-16, the former group being connected to side cathode bus bars 3-1 on the upstream side and connected to a side cathode bus bar 3-3 on the downstream side, whereas the latter group being connected to side cathode bus bars 3-2 on the upstream side and connected to a side cathode bus bar 3-4 on the downstream side. Although in FIG. 2, the side bus bars 3-1 and 3-2 are respectively divided into two sections at the central portions, each one of the bus bars can be made as a single bus bar. Further, instead of abutting the inner ends of bus bars 3-1 and 3-2, they may be separated. Connecting bus bars 4-1, 4-2 and 4-3 extend beneath the bottom of the cell respectively from the outer end of the bus bar 3-1, from the abutting (inner) ends of the bus bars 3-1 and 3-2 and from the outer end of the bus bar 3-2 to a space between adjacent cells 1. In FIG. 2, the inner ends of the side cathode bus bars 3-1 and 3-2 are connected. Therefore, connecting bus bar 4-2 is common to both cathode bus bars. Further, connecting bus bars 4-4 and 4-5 extend from the central portions of side cathode bus bars 3-3 and 3-4 respectively to an intermediate point between an upper side cell and a cell on the downstream side thereof. The connecting bus bars 4-1 through 4-5 are respectively connected to the anode bus bars 5 of the next cell at points between two adjacent cells 1. Thus, the connecting bus bars 4-1 through 4-5 are connected to the anode electrodes 6 of the next cell 1 on the downstream side. Consequently, with the cell arrangement shown in FIG. 2, current flows through respective side cathode bus bars in directions shown by arrows. With the bus bar arrangement shown in FIG. 2, since the current flown out from one cell to the side cathode bus bars flows to the next cell through a number of current paths, the current would not excessively concentrate near the shorter side walls of the cells, thus preventing the gradient of the vertical magnetic field created by the current flowing through the side cathode bus bars and the connecting bus bars from becoming too large near the shorter side walls. Furthermore, in a space between adjacent electrolytic cells, as the currents flow in the opposite directions through opposite side cathode bus bars, the magnetic fields created by these currents cancel with each other. In addition, the magnetic fields created by the currents flowing into the connecting bus bar in the opposite directions from side cathode bus bars on each side of a cell also cancel with each other. The vertical fields created by currents flowing through the side cathode bus bars have the same direction at respective points on the upstream side of one cell and at corresponding points on the downstream side of the same cell.

As a consequence of these facts, according to this invention, both the intensity and the gradient of the vertical magnetic field passing through the molten aluminum can be made small, whereby the force acting upon the molten aluminum is reduced to efficiently prevent bending and fluctuation of the surface of the molten aluminum.

Figure 3:
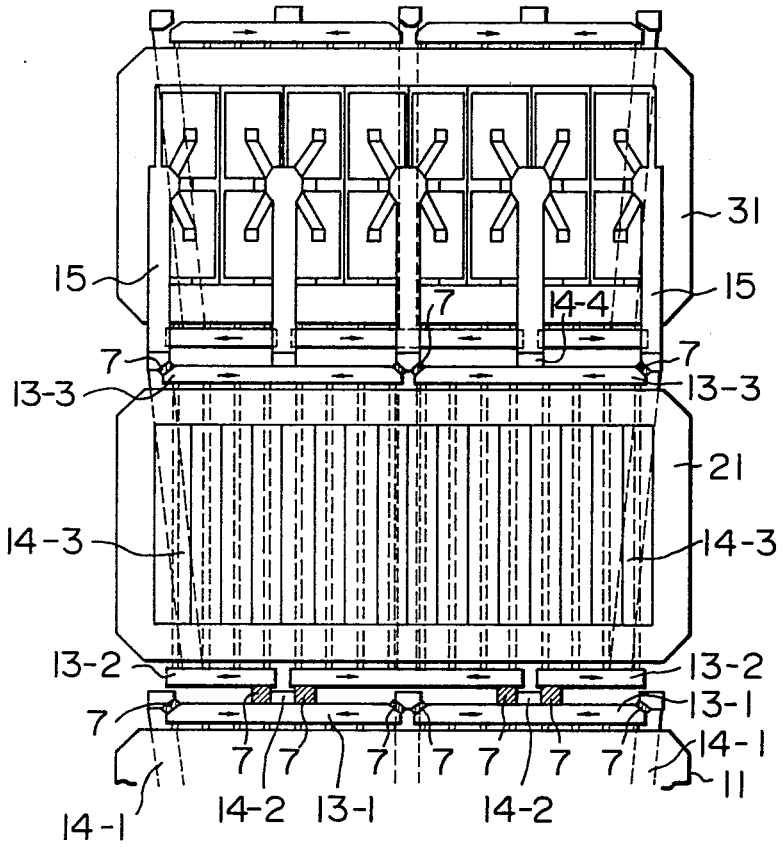
FIG. 3 is a diagrammatic plan view showing a method of supplying electric power to an array of electrolytic cells where one of the cells is not in operation.

Another advantage of this invention lies in that it is also possible to maintain the magnetic field distribution of an electrolytic cell adjacent to a quiescent cell (that is not in operation) in a satisfactory state. In other words, where there is a quiescent cell in an array of electrolytic cells, the cathode bus bars on one side of the quiescent cell are interconnected by removable short circuiting plugs 7 as shown in FIG. 3 so that currents will flow through these side bus bars in the same direction as in the side bus bars of the cells in operation. More particularly, in FIG. 3, it is assumed that a cell 21 is quiescent. Connecting bus bars 14-1 from the upstream side of an operating cell 11 adjacent to the cell 21 on the upstream side thereof are electrically connected to the side cathode bus bars 13-1 between the cells 11 and 21 by removable short circuiting plugs 7, while the side cathode bus bars 13-1 and connecting bus bars 14-2 from the downstream side of the cell 11 are electrically connected to the side cathode bus bars 13-2 on the upstream side of the quiescent cell 21 through removable short circuiting plugs 7. On the downstream side of the quiescent cell 21, the connecting bus bars 14-3 from the upstream side thereof are connected to the anode bus bars 15 of an operating cell 31 on the downstream side of the quiescent cell 21 and to the side cathode bus bars 13-3 on the downstream side of the quiescent cell 21. The connecting bus bars 14-4 on the downstream side of the quiescent cell 21 are connected to the anode bus bars 15 of the next cell 31. With the bus bar arrangement described above, as shown by arrows in FIG. 3, the direction of current flow of one operating cell is the same as that of another operating cell even when there is a quiescent cell, so that the magnetic field distribution can be maintained in a favorable state.

Figure 1:
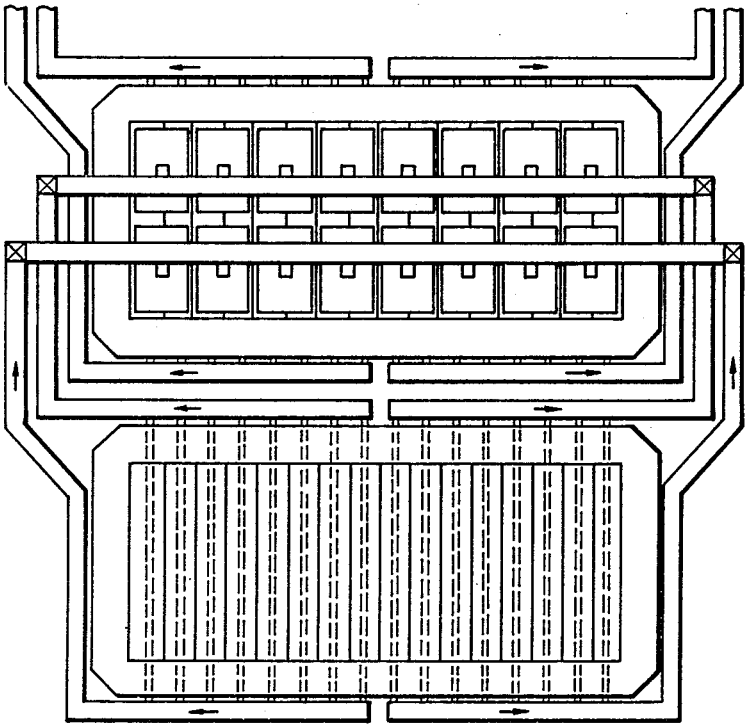
FIG. 1 PRIOR ART
FIG. 1 is a diagrammatic plan view showing aluminum electrolytic cells arranged side by side and having prebaked anode electrodes and bus bars arranged to supply electric power to the cells according to a prior art method.
Figure 4:
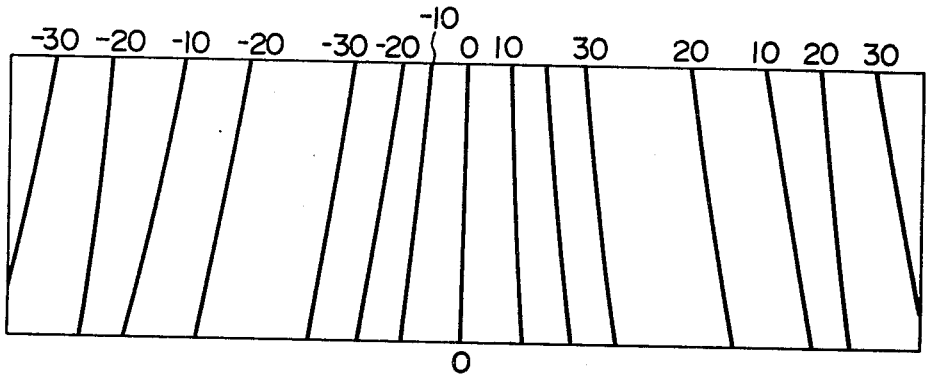
FIG. 4 is a graph showing the horizontal distribution of the vertical magnetic field in molten aluminum in one electrolytic cell where electric power is supplied by the method of this invention shown in FIG. 2.
Figure 5:
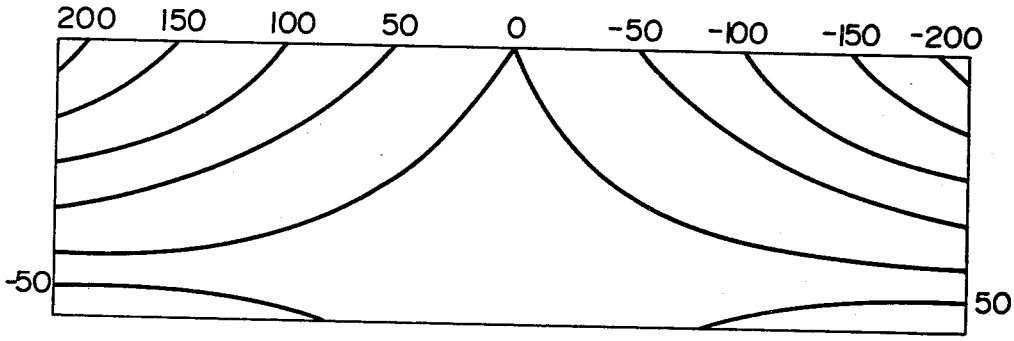
FIG. 5 PRIOR ART
FIG. 5 is a graph showing the horizontal distribution of the vertical magnetic field in the molten aluminum of an electrolytic cell where electric power is supplied according to the prior art method shown in FIG. 1.

One example of the horizontal distribution of the vertical magnetic field in the molten aluminum in an electrolytic cell where electric power is fed thereto according to the method of this invention is illustrated in FIG. 4 in which the field intensity is expressed in Gauss. FIG. 4 shows calculated values of the vertical magnetic field of an electrolytic cell (width: 3 m, length: 10 m, current capacity: 200 kA) having a bus bar arrangement as shown in FIG. 2. When the same cell is provided with the bus bar arrangement as shown in FIG. 1, the calculated values of the vertical magnetic field are shown by FIG. 5 also in Gauss. Comparison of FIGS. 4 and 5 shows that according to this invention, the intensity of the vertical magnetic field is greatly weakened and that its distribution is made more uniform.

Although in the foregoing description, the cathode current collecting bars were divided into two groups respectively containing the same number of bars, and the current was collected at both ends of respective side cathode bus bars on the upstream side, whereas on the down stream side, the current was collected at the central portions of respective side cathode bus bars, it should be understood that the invention is not limited to such arrangement. For example, although it is advantageous to divide the current collecting cathode bars into two groups respectively including the same number of bars, in a certain case the number of bars in respective groups may be different. It is also possible to collect the current at the central position of the side cathode bus bar on the upstream side, while at both ends thereof on the downstream side.

The number of the groups of the current collecting cathode bars is not limited to two and may be of much number. Generally stated, the number of divided groups increases with the current capacity of the electrolytic cell. For example, in a cell having a current capacity of 150 kA, it is advantageous to divide the current collecting cathode bars into 2 or 3 groups, while in a cell having a current capacity of 250 kA a preferred number of the divided groups is four. The degree of current concentration at any portion of the bus bars about a cell decreases with the number of groups, whereby the method of power supply of this invention becomes more effective.

Although in the foregoing description the connecting bus bars extend from the center and opposite ends of a group of the current collecting cathode bars, the connecting bus bars may extend from somewhat different positions. For example, in an example shown in FIG. 2, connecting bus bars 4-1 and 4-3 extend from positions apart from both ends by one current collecting cathode bar respectively.

As above described according to this invention it is possible to decrease the intensity and the gradient of the vertical magnetic field in the molten aluminum in an aluminum electrolytic cell so that the electromagnetic force acting upon the molten aluminum can be decreased thereby preventing bending or fluctuation of the surface of the molten aluminum.

We claim:

1. A method of supplying electric power to an array of a plurality of rectangular aluminum electrolytic cells which are arranged side by side, each cell being provided with a plurality of anode electrodes, a plurality of current collecting cathode bars parallel with shorter side walls thereof and located at a bottom of said cell, and a plurality of current collecting cathode bus bars disposed along longer side walls of said cell, said method comprising the steps of:

dividing current collecting cathode bars into a plurality of groups each consisting of adjacent current collecting cathode bars along said longer side walls of respective cells;

collecting current flowing through respective of said groups of current collecting cathode bars at their centers on one sides of respective cells;

collecting current flowing through respective current collecting cathode bar groups at their opposite ends on the other sides of respective cells; and supplying current to said anode electrodes of a next cell from respective current collecting points through connecting bus bars extending above the longer side wall on an upstream side of said next cell, connecting bus bars from respective current collecting points on the upstream side of said respective cells extending beneath said cells.

2. The method according to claim 1 which further comprises the steps of electrically connecting connecting-bus bars from the upstream side of an operating cell to cathode bus bars of said operating cell on the downstream side thereof and to cathode bus bars of a quiescent cell on the upstream side thereof, and connecting connecting-bus bars from the upstream side of said quiescent cell to anode electrodes of an operating cell on the downstream side of said quiescent cell.

3. An array of a plurality of rectangular aluminum electrolytic cells which are arranged side by side;

each cell being provided with a plurality of anode electrodes, a plurality of current collecting cathode bars parallel with shorter side walls thereof and located at a bottom of said cell, and a plurality of current collecting cathode bus bars disposed along longer side walls of said cell;

current collecting cathode bars being divided along said longer side walls of respective cells into a plurality of groups each consisting of adjacent current collecting cathode bars;

means for collecting current flowing through respective of said groups of current collecting cathode bars at their centers on one sides of respective cells;

means for collecting current flowing through respective current collecting cathode bar groups at opposite ends of said groups on the other side of respective cells; and means including connecting bus bars for supplying collected currents to the anode electrodes of the next electrolytic cell, said connecting bus bars extending above the longer side wall on an upstream side of said next cell, and connecting bus bars from the upstream side of said respective cells extending beneath said cells.

4. The array according to claim 3 wherein the numbers of the current collecting cathode bars of respective groups are the same.

5. The array according to claim 3 wherein the number of the groups of the current collecting cathode bars is two.

6. The array according to claim 3 which further comprises means for electrically connecting connecting-bus bars from the upstream side of an operating cell to cathode bus bars of said operating cell on the downstream side thereof and to cathode bus bars of a quiescent cell on the upstream side thereof and means for electrically connecting connecting-bus bars from the upstream side of said quiescent cell to anode electrodes of an operating cell on the downstream side of said quiescent cell.

7. The array according to claim 6 wherein both of said electrically connecting means comprise removable electroconductive plugs.

* * * * *